US009289340B2

(12) United States Patent
Serhan

(10) Patent No.: US 9,289,340 B2
(45) Date of Patent: Mar. 22, 2016

(54) RETRACTABLE SIDE RAIL MOUNTING ASSEMBLY

(71) Applicant: Drive Medical Design & Mfg., Port Washington, NY (US)

(72) Inventor: Michael Serhan, Acadia, CA (US)

(73) Assignee: Drive Medical Design & Mfg., Port Washington, NY (US)

( * ) Notice: Subject to any disclaimer, the term of this patent is extended or adjusted under 35 U.S.C. 154(b) by 399 days.

(21) Appl. No.: 13/656,817

(22) Filed: Oct. 22, 2012

(65) Prior Publication Data

US 2013/0097778 A1 Apr. 25, 2013

Related U.S. Application Data

(60) Provisional application No. 61/550,005, filed on Oct. 21, 2011.

(51) Int. Cl.
*A61G 7/05* (2006.01)

(52) U.S. Cl.
CPC ..... *A61G 7/0507* (2013.01); *A61G 2007/0518* (2013.01); *A61G 2007/0519* (2013.01); *A61G 2203/12* (2013.01)

(58) Field of Classification Search
CPC ..... A47C 21/08; A47C 21/00
USPC ..... 5/430, 428, 425, 424
See application file for complete search history.

(56) References Cited

U.S. PATENT DOCUMENTS

| | | | | | |
|---|---|---|---|---|---|
| 276,212 | A * | 4/1883 | Bardwell | 5/179 |
| 2,478,028 | A * | 8/1949 | Travis | 5/100 |
| 2,750,605 | A * | 6/1956 | Blevins | 5/430 |
| 3,486,176 | A * | 12/1969 | Murcott | 5/428 |
| 4,724,559 | A * | 2/1988 | Bly et al. | 5/425 |
| 5,038,430 | A * | 8/1991 | Bly | 5/425 |
| 6,397,416 | B2 * | 6/2002 | Brooke et al. | 5/662 |
| 7,003,824 | B2 * | 2/2006 | Roussy | 5/430 |
| 7,028,352 | B2 * | 4/2006 | Kramer et al. | 5/425 |
| 7,137,160 | B2 * | 11/2006 | Hand et al. | 5/607 |
| 2003/0093860 | A1 * | 5/2003 | Kramer et al. | 5/600 |
| 2003/0229941 | A1 * | 12/2003 | Hueppe | 5/430 |

* cited by examiner

*Primary Examiner* — Peter M Cuomo
*Assistant Examiner* — Ifeolu Adeboyejo
(74) *Attorney, Agent, or Firm* — Carter, DeLuca, Farrell & Schmidt, LLP

(57) ABSTRACT

A patient care bed includes a frame, a side rail, and a side rail mounting assembly. The side rail mounting assembly includes a rail-receiving member defining a passageway configured to releasably receive the side rail and a support rod fixedly engaged to and extending from the rail-receiving member. The support rod is slidable relative to the frame between a storage position, wherein the rail-receiving member is disposed within the frame, and a use position, wherein the rail-receiving member is disposed outside the frame. The support rod is rotatable relative to the frame between a storage orientation, wherein the rail-receiving member is horizontal, and a use orientation, wherein the rail-receiving member is vertical. The side rail mounting assembly is transitionable between a storage condition, corresponding to the storage position and orientation of the support rod, and a use condition, corresponding to the use position and orientation of the support rod.

6 Claims, 4 Drawing Sheets

RETRACTABLE SIDE RAIL MOUNTING ASSEMBLY

CROSS-REFERENCE TO RELATED APPLICATIONS

This application claims the benefit of, and priority to, U.S. Provisional Patent Application No. 61/550,005, filed on Oct. 21, 2011, the entire contents of which are hereby incorporated by reference herein.

BACKGROUND

1. Technical Field

The present disclosure relates to patient care beds, and more particularly, to a retractable side rail mounting assembly for use in a patient care bed.

2. Background of Related Art

Adjustable beds are used in both home care and in more formalized medical settings, e.g., hospital rooms. Adjustable beds generally include a fixed frame, adjustable leg assemblies supporting the fixed frame, and an articulating bed frame coupled to the fixed frame and configured to support a mattress thereon. The adjustable leg assemblies permit height adjustment of the fixed frame relative to the floor, while the articulating bed frame is selectively articulatable to orient the patient in a desired position, e.g., a lying position, a sitting position, etc. Thus, adjustable beds can be adapted for use in various different configurations, depending on the setting, e.g., home care or hospital, the condition of the patient, treatment protocol, or other factors.

In some instances, it is necessary to provide side rails on either or both sides of the bed. However, because not all situations call for either or both side rails, it is desirable that the side rails are easily installed and removed from the bed. With this in mind, mounting structures that extend outwardly from the bed frame, rather than being positioned underneath or within the bed frame, have been provided to facilitate the installation and removal of the side rails. Such mounting structures, although easily accessible, increase the dimensions of the bed, may interfere with a patient's ability to get into or out of the bed, and/or provide obstacles to others in the general vicinity of the bed.

SUMMARY

In accordance with the present disclosure, a patient care bed is provided. The patient care bed includes a frame, a side rail, and a side rail mounting assembly. The side rail mounting assembly includes a rail-receiving member and a support rod. The rail-receiving member defines a passageway extending therethrough that is configured to releasably receive at least a portion of the side rail to releasably couple the side rail to the frame. The support rod is fixedly engaged to and extends from the rail-receiving member. The support rod is slidably and rotatably coupled to the frame. More specifically, the support rod is slidable relative to the frame between a storage position, wherein the rail-receiving member is disposed within peripheral dimensions of the frame, and a use position, wherein the rail-receiving member is disposed outside the peripheral dimensions of the frame. The support rod is also rotatable relative to the frame between a storage orientation, wherein the rail-receiving member is horizontally oriented, and a use orientation, wherein the rail-receiving member is vertically oriented. Thus, the side rail mounting assembly is capable of being transitioned between a storage condition, corresponding to the storage position and storage orientation of the support rod, and a use condition, corresponding to the use position and use orientation of the support rod.

In embodiments, the frame includes at least one mounting flange configured to slidably and rotatably receive the support rod between first and second ends of the support rod.

In embodiments, the rail-receiving member is disposed at the first end of the support rod and a stop member is disposed at the second end of the support rod.

In embodiments, a biasing member is disposed about the support rod between the at least one mounting flange and the stop member to bias the support rod towards the storage position.

In embodiments, interference between the rail-receiving member and frame inhibits sliding of the support rod from the use position to the storage position when the support rod is oriented in the use orientation.

In embodiments, the rail-receiving member includes a spring pin configured to releasably engage the at least a portion of the side rail within the passageway of the rail-receiving member.

In embodiments, first and second side rails and a plurality of side rail mounting assemblies are provided. At least one side rail mounting assembly is configured to releasably couple the first side rail to a first side of the frame and at least another side rail mounting assembly is configured to releasably couple the second side rail to a second side of the frame.

A side rail mounting assembly provided in accordance with the present disclosure and configured for use with a patient care bed includes a rail-receiving member and a support rod. The rail-receiving member defines a passageway extending therethrough that is configured to releasably receive at least a portion of a side rail. The support rod is fixedly engaged to and extends from the rail-receiving member. The support rod is slidably and rotatably coupled to a frame of a patient care bed such that: the support rod is slidable relative to the frame between a storage position, wherein the rail-receiving member is disposed within peripheral dimensions of the frame, and a use position, wherein the rail-receiving member is disposed outside the peripheral dimensions of the frame; and the support rod is rotatable relative to the frame between a storage orientation, wherein the rail-receiving member is horizontally oriented, and a use orientation, wherein the rail-receiving member is vertically oriented. As such, the side rail mounting assembly is capable of transitioning between a storage condition, corresponding to the storage position and storage orientation of the support rod, and a use condition, corresponding to the use position and use orientation of the support rod.

In embodiments, the rail-receiving member is disposed at a first end of the support rod and a stop member is disposed at a second end of the support rod.

In embodiments, a biasing member is disposed about the support rod and is configured to bias the support rod towards the storage position.

In embodiments, the rail-receiving member includes a spring pin configured to releasably engage the at least a portion of the side rail within the passageway of the rail-receiving member.

A method of configuring a patient care bed provided in accordance with the present disclosure includes providing a patient care bed, e.g., similar to the patient care bed described herein, although other patient care beds may also be provided, and determining whether the patient care bed is to be used with a side rail or whether the patient care bed is to be used without a side rail. If it is determined that the patient care bed is to be used with a side rail, the side rail mounting assembly is transitioned to a use condition, wherein the rail-receiving member is disposed outside peripheral dimensions of the frame and is disposed in a use orientation. On the other hand, if it is determined that the patient care bed is to be used without a side rail, the side rail mounting assembly is transitioned to a storage condition, wherein the rail-receiving member is disposed within the peripheral dimensions of the frame and is disposed in a storage orientation.

In embodiments, after transitioning the side rail mounting assembly to the use condition once it has been determined that the patient care bed is to be used with a side rail, the method may further including engaging a portion of a side rail within the passageway of the rail-receiving member.

In embodiments, transitioning the side rail mounting assembly to the use condition includes sliding the support rod relative to the frame such that the rail-receiving member is moved outside the peripheral dimensions of the frame and rotating the support rod relative to the frame such that the rail-receiving member is disposed in a vertical orientation.

In embodiments, transitioning the side rail mounting assembly to the storage condition includes rotating the support rod relative to the frame such that the rail-receiving member is disposed in a horizontal orientation and sliding the support rod relative to the frame such that the rail-receiving member is moved inside the peripheral dimensions of the frame.

BRIEF DESCRIPTION OF THE DRAWINGS

Various embodiments of the present disclosure are described with reference to the accompanying drawing figures, wherein.

DETAILED DESCRIPTION

Various exemplary embodiments of the presently disclosed subject matter will now be described in detail with reference to the drawings, wherein like references characters identify similar or identical elements.

Figure 1:
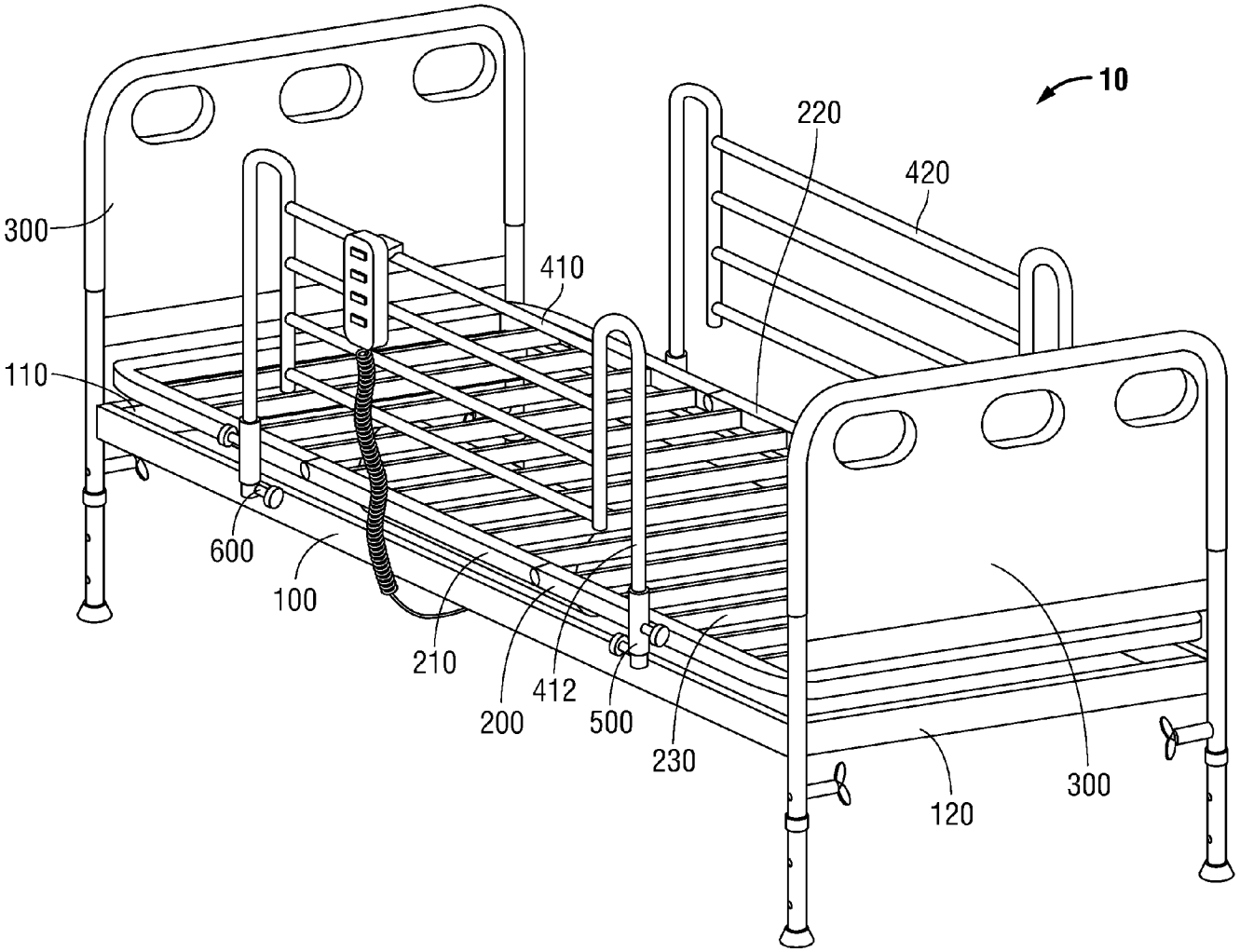
FIG. 1 is a perspective view of one embodiment of an adjustable bed provided in accordance with the present disclosure.

Turning now to FIG. 1, an adjustable bed system provided in accordance with embodiments of the present disclosure is shown generally identified by reference numeral 10. Bed system 10 may find application in both hospital settings as well as in private home care settings. Bed system 10 generally includes a fixed frame 100, an articulatable frame 200 articulatably mounted on fixed frame 100, a pair of leg and end board assemblies 300 coupled to fixed frame 100 at either end 110, 120 thereof, and first and second side rails 410, 420 coupled to articulatable frame 200 and extending along first and second sides 210, 220, respectively, thereof. A first pair of retractable side rail mounting assemblies 500, 600 couples first side rail 410 to first side 210 of articulatable frame 200 at two positions therealong. A second pair of retractable side rail mounting assemblies (not explicitly shown) likewise couples second side rail 420 to second side 220 of articulatable frame 200 at two positions therealong. However, it is also envisioned that greater than two positions for mounting side rails 410, 420 to articulatable frame 200 be provided and/or that side rails 410, 420 be mounted to fixed frame 100, rather than articulatable frame 200.

Figure 2:
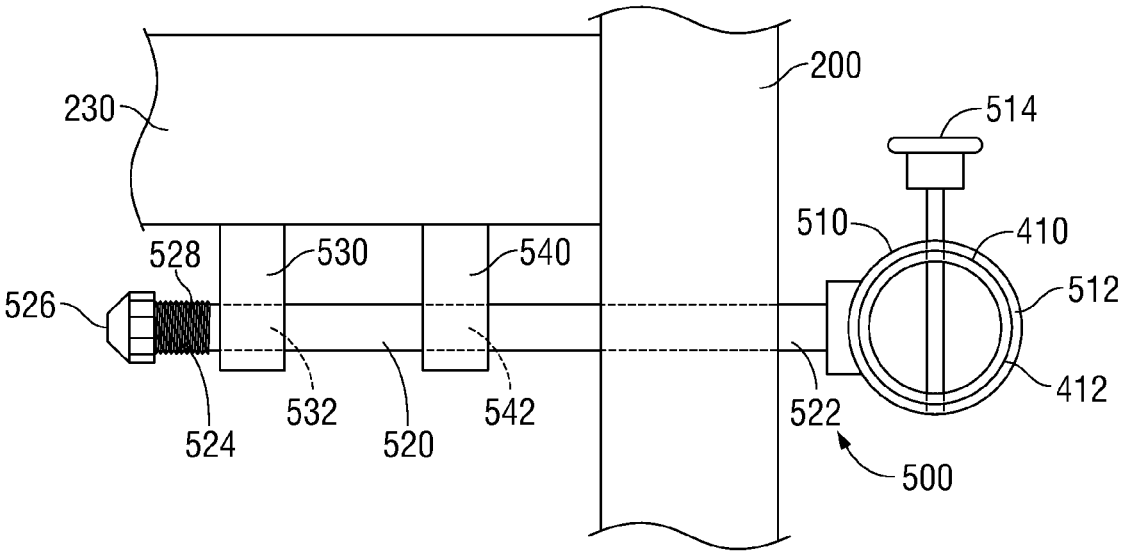
FIG. 2 is a greatly enlarged, top view of the area of detail indicated in FIG. 1, showing a side rail mounting assembly provided in accordance with the present disclosure.
Figure 3:
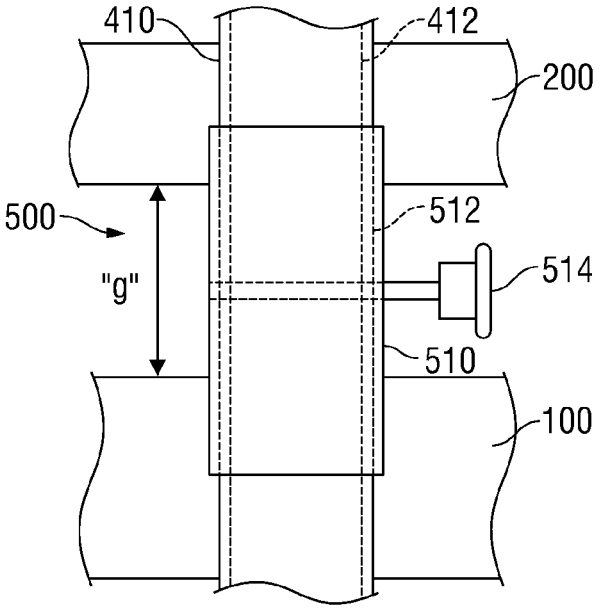
FIG. 3 is a greatly enlarged, side view of the area of detail indicated in FIG. 1, showing the side rail mounting assembly of FIG. 2.

Turning now to FIGS. 2-3, retractable side rail mounting assembly 500 is described. The first pair of side rail mounting assemblies 500, 600 and the second pair of side rail mounting assemblies (not explicitly shown) are substantially similar to one another and, thus, only side rail mounting assembly 500 is described hereinbelow to avoid unnecessary repetition. Further, although side rail mounting assembly 500 is shown configured for use with bed system 10 and side rail 410, it is envisioned that side rail mounting assembly 500 be configured for use with any suitable bed system and/or side rail.

With continued reference to FIGS. 2-3, retractable side rail mounting assembly 500 generally includes a rail-receiving member, or cylinder 510 that is engaged, e.g., welded or otherwise secured, to a support rod 520 at an outer end 522 of support rod 520 in generally perpendicular relation relative to support rod 520. Rail-receiving cylinder 510 includes a lumen 512 extending therethrough that is configured to receive a support post 412 of side rail 410 therein. Rail-receiving cylinder 510 may include a spring pin 514 coupled thereto and configured for engagement within an aperture (not explicitly shown) defined transversely through support post 412 of side rail 410 to retain support post 412 in fixed position within rail-receiving cylinder 510. Alternatively, any other releasable engagement mechanism may be used to releasable secure support post 412 within rail-receiving cylinder 510. Further, although shown as a cylinder configured to receive the complementary-shaped cylindrical support post 412, it is envisioned that rail-receiving member 510 may alternatively define any other configuration suitable to receive a support post 412 of a side rail 410 therethrough.

Support rod 520 is slidably and rotatably coupled to articulatable frame 200 via a pair of mounting flanges 530, 540. Each mounting flange 530, 540 is engaged, e.g., welded or otherwise secured to a crossbar 230 of articulatable frame 200, and defines an aperture 532, 542 extending transversely therethrough. Apertures 532, 542 are configured to receive support rod 520 therethrough and to permit rotation and translation of support rod 520 relative to mounting flanges 530, 540. Support rod 520 further includes a cap, or nut 526 coupled thereto at inner end 524 thereof. Nut 526 inhibits support rod 520 from translating too far outwardly relative to mounting flanges 530, 540, thereby inhibiting withdrawal of support rod 520 from apertures 532, 542 in the outward direction, e.g., away from articulatable frame 200, while rail-receiving cylinder 510 inhibits support rod 520 from translating too far inwardly relative to mounting flanges 530, 540, thereby inhibiting withdrawal of support rod 520 from apertures 532, 542 in the inward direction, e.g., inwardly towards a longitudinal axis of articulatable frame 200. That is, support rod 520 is translatable between an outward, extended, or use position, wherein nut 526 is positioned adjacent mounting flange 530 and wherein rail-receiving cylinder 510 extends outwardly from articulatable frame 200; and an inward, retracted, or storage position, wherein rail-receiving cylinder 510 is positioned within the peripheral dimensions of articulatable frame 200 and adjacent mounting flange 540. A spring 528 is disposed about support rod 520 between nut 526 and mounting flange 530 to bias support rod 520 towards the refracted, or storage position, although it is also envisioned that support rod 520 be biased towards the extended, or use position, or that support rod 520 be substantially unbiased.

As mentioned above, support rod 520 and, thus, rail-receiving cylinder 510, are rotatable relative to mounting flanges 530, 540 and, thus, relative to articulatable frame 200. More specifically, support rod 520 and rail-receiving cylinder 510 are rotatable between a use orientation, wherein rail-receiving cylinder 510 is generally vertically oriented, substantially perpendicular to articulatable frame 200; and a storage orientation, wherein rail-receiving cylinder 510 is generally horizontally oriented, substantially parallel to articulatable frame 200. In the use orientation, the generally vertical position of rail-receiving cylinder 510 facilitates the engagement of support post 412 of side rail 410 therein. In the storage orientation, on the other hand, the lower profile of rail-receiving cylinder 510 facilitates the translation of support rod 520 between the extended, or use position and refracted, or storage position.

Turning now to FIGS. 4A-4C and 5A-5C, the use and operation of side rail mounting assembly 500 is described. Additional features of side rail mounting assembly 500 will become apparent in view of the following.

Figure 4A:
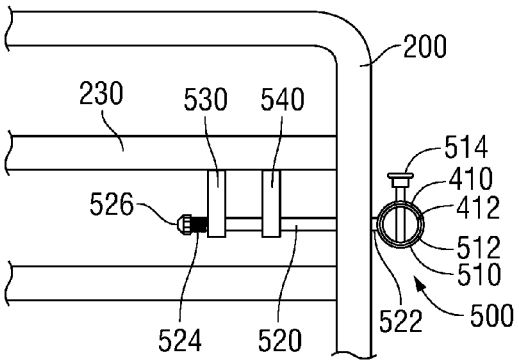
FIG. 4A is a top view of a portion of a bed frame including the side rail mounting assembly of FIG. 2 coupled thereto and disposed in a use state.
Figure 5A:
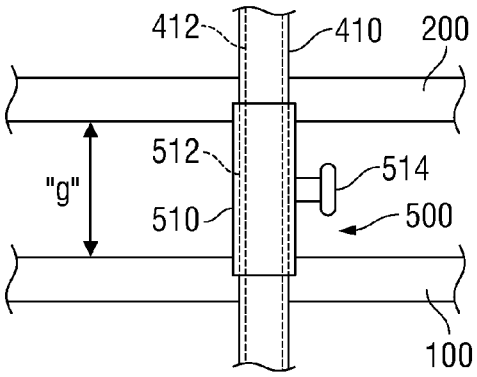
FIG. 5A is a side view of the portion of the bed frame including the side rail mounting assembly of FIG. 2 coupled thereto and disposed in the use state.

With initial reference to FIGS. 4A and 5A, side rail mounting assembly 500 is shown disposed in a use state, wherein support rod 520 and rail-receiving cylinder 510 are disposed in the use position and the use orientation. That is, in the use state, support rod 520 is positioned such that rail-receiving cylinder 510 extends outwardly from articulatable frame 200 (e.g., the extended position) and such that rail-receiving cylinder 510 is generally vertically oriented, substantially perpendicular to articulatable frame 200 (e.g., the use orientation). With support rod 520 and rail-receiving cylinder 510 in the use orientation, rail-receiving cylinder 510 extends upwardly to at least partially intersect the plane defined by articulatable frame 200. Thus, retraction of support rod 520 is inhibited in that rail-receiving cylinder 510 will eventually contact the outer, side surface of articulatable frame 200, thereby inhibiting further retraction of support rod 520. Put more generally, rail-receiving cylinder 510, in the use orientation, inhibits support rod 520 from returning under bias back to the retracted, or storage position.

Continuing with reference to FIGS. 4A and 5A, with side rail mounting assembly 500 disposed in the use state, support post 412 of side rail 410 may be inserted into lumen 512 of rail-receiving cylinder 510 and may be secured therein at a desired height by the engagement of spring pin 514 within an aperture (not explicitly shown) extending therethrough. In other words, in the use state, side rail 410 may be easily engaged within side rail mounting assembly 500 to secure side rail 410 to articulatable frame 200.

Figure 4B:
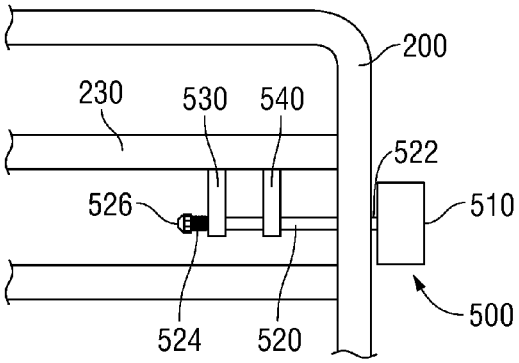
FIG. 4B is a top view of the portion of the bed frame including the side rail mounting assembly of FIG. 2 coupled thereto and transitioning between the use state and a storage state.
Figure 4C:
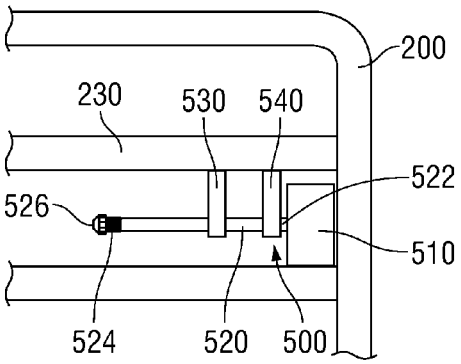
FIG. 4C is a top view of the portion of the bed frame including the side rail mounting assembly of FIG. 2 coupled thereto and disposed in the storage state.
Figure 5B:
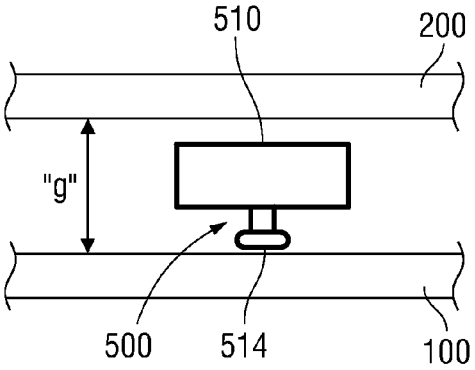
FIG. 5B is a side view of the portion of the bed frame including the side rail mounting assembly of FIG. 2 coupled thereto and transitioning between the use state and the storage state.

Turning now to FIGS. 4B-4C and 5B-5C, if side rail 410 is not being used, side rail mounting assembly 500 may be transitioned to a storage state, wherein side rail mounting assembly 500 is out of the way of patients, clinicians, or others in the general vicinity of bed system 10. In order to transition side rail mounting assembly 500 from the use state (FIGS. 4A and 5A) to the storage state (FIGS. 4C and 5C), as shown in FIGS. 4B and 5B, support rod 520 is first rotated from the use orientation to the storage orientation. In the storage orientation, rail-receiving cylinder 510 defines a reduced profile, no longer intersecting the plane defined by articulatable frame 200. That is, in the storage orientation, rail-receiving cylinder 510 no longer inhibits support rod 520 from returning under bias back to the retracted or storage position.

Figure 5C:
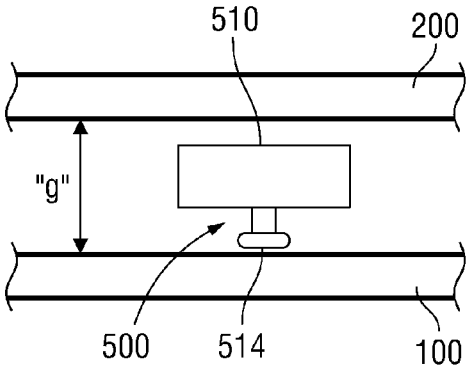
FIG. 5C is a side view of the portion of the bed frame including the side rail mounting assembly of FIG. 2 coupled thereto and disposed in the storage state.

Referring now to FIGS. 4C and 5C, once rail-receiving cylinder 510 is rotated to the storage orientation, support rod 520 is returned under bias back towards the retracted, or storage position, wherein rail-receiving cylinder 510 passes through the gap "g" defined between articulatable frame 200 and fixed frame 100 to the storage state, wherein rail-receiving cylinder 510 is positioned within the peripheral dimensions of articulatable frame 200 and adjacent mounting flange 540. Alternatively, in embodiments where support rod 520 is not biased towards the retracted, or storage position, support rod 520 may simply be slid inwardly to the retracted, or storage position. Further, in some embodiments, a slot (not explicitly shown) may be defined within articulatable frame 200 and/or fixed frame 100 to facilitate passage of rail-receiving cylinder 510 therebetween.

With reference to FIGS. 4A-4C and 5A-5C, in order to return side rail mounting assembly 500 to the use position, with rail-receiving cylinder 510 disposed in the storage orientation, support rod 520 is slid, or translated outwardly relative to articulatable frame 200 from the retracted position towards the extended position such that rail-receiving cylinder 510 passes through the gap "g" defined between articulatable frame 200 and fixed frame 100 to a position externally thereof. Once rail-receiving cylinder 510 is clear, i.e., externally disposed, relative to articulatable frame 200, rail-receiving cylinder 510 and support rod 520 may be rotated back to the use orientation to retain side rail mounting assembly 500 in the use position, wherein rail-receiving cylinder 510 is presented to facilitate engagement of side rail 410 thereto.

The above description, disclosure, and figures should not be construed as limiting, but merely as exemplary of particular embodiments. It is to be understood, therefore, that the disclosure is not limited to the precise embodiments described, and that various other changes and modifications may be effected by one skilled in the art without departing from the scope or spirit of the present disclosure. Additionally, persons skilled in the art will appreciate that the features illustrated or described in connection with one embodiment may be combined with those of another, and that such modifications and variations are also intended to be included within the scope of the present disclosure. Therefore, the above description should not be construed as limiting, but merely as exemplifications of particular embodiments.

What is claimed is:

1. A patient care bed, comprising:

a frame defining first and second opposed ends and first and second sides opposed sides; a side rail; and a side rail mounting assembly coupled to the frame, the side rail mounting assembly including:

a rail-receiving member defining a passageway extending therethrough that is configured to releasably receive at least a portion of the side rail to releasably couple the side rail to the frame adjacent the first or second sides thereof; and a support rod defining a longitudinal axis and being fixedly engaged to and extending from the rail-receiving member, the support rod slidably and rotatably coupled to the frame, the support rod slidable relative to the frame along the longitudinal axis between a storage position, wherein the rail-receiving member is disposed within peripheral dimensions of the frame, and a use position, wherein the rail-receiving member is disposed outside the peripheral dimensions of the frame, the support rod rotatable relative to the frame about the longitudinal axis between a storage orientation, wherein the rail-receiving member is horizontally oriented, and a use orientation, wherein the rail-receiving member is vertically oriented, wherein the side rail mounting assembly is transitionable between a storage condition, corresponding to the storage position and storage orientation of the support rod, and a use condition, corresponding to the use position and use orientation of the support rod, wherein the frame includes at least one mounting flange configured to slidably and rotatably receive the support rod between first and second ends opposing terminal ends of the support rod, wherein the rail-receiving member is disposed at the first end of the support rod and wherein a stop member is disposed at the second end of the support rod; further comprising a biasing member disposed about and surrounding the support rod between the at least one mounting flange and the stop member to bias the support rod towards the storage position.

2. The patient card bed according to claim 1, wherein interference between the rail-receiving member and frame inhibits sliding of the support rod from the use position to the storage position when the support rod is oriented in the use orientation.

3. The patient care bed according to claim 1, wherein the rail-receiving member includes a spring pin configured to releasably engage the at least a portion of the side rail within the passageway of the rail-receiving member.

4. The patient care bed according to claim 1, further comprising first and second side rails and a plurality of side rail mounting assemblies, at least one side rail mounting assembly configured to releasably couple the first side rail to the first side of the frame and at least another side rail mounting assembly configured to releasably couple the second side rail to the second side of the frame.

5. A side rail mounting assembly for use with a patient care bed, the side rail mounting assembly comprising:

a rail-receiving member defining a passageway extending therethrough that is configured to releasably receive at least a portion of a side rail; and a support rod fixedly engaged to and extending from the rail-receiving member, the support rod defining a longitudinal axis, the support rod slidably and rotatably coupled to a frame of a patient care bed, the support rod slidable along the longitudinal axis and relative to the frame between a storage position, wherein the rail-receiving member is disposed within peripheral dimensions of the frame, and a use position, wherein the rail-receiving member is disposed outside the peripheral dimensions of the frame, the support rod rotatable about the longitudinal axis and relative to the frame between a storage orientation, wherein the rail-receiving member is horizontally oriented, and a use orientation, wherein the rail-receiving member is vertically oriented, wherein the side rail mounting assembly is transitionable between a storage condition, corresponding to the storage position and storage orientation of the support rod, and a use condition, corresponding to the use position and use orientation of the support rod, wherein the frame includes at least one mounting flange configured to slidably and rotatably receive the support rod between first and second ends opposing terminal ends of the support rod, wherein the rail-receiving member is disposed at the first end of the support rod and wherein a stop member is disposed at the second end of the support rod; further comprising a biasing member disposed about and surrounding the support rod between the at least one mounting flange and the stop member to bias the support rod towards the storage position.

6. The side rail mounting assembly according to claim 5, wherein the rail-receiving member includes a spring pin configured to releasably engage the at least a portion of the side rail within the passageway of the rail-receiving member.

* * * * *